US006213407B1

(12) United States Patent
Ellis et al.

(10) Patent No.: US 6,213,407 B1
(45) Date of Patent: Apr. 10, 2001

(54) TWO-PIECE RAIL SEAL CLIP AND TOOL FOR INSTALLING SAME

(75) Inventors: Richard Ellis; Christopher Whelan, both of Kitchener (CA)

(73) Assignee: Polycorp Inc., Elora (CA)

( * ) Notice: Subject to any disclaimer, the term of this patent is extended or adjusted under 35 U.S.C. 154(b) by 0 days.

(21) Appl. No.: 09/198,365

(22) Filed: Nov. 24, 1998

(30) Foreign Application Priority Data

Oct. 22, 1998 (CA) ..... 2251490

(51) Int. Cl.[7] ..... E01B 23/00

(52) U.S. Cl. ..... 238/310; 238/314; 238/338; 238/378; 238/8

(58) Field of Search ..... 238/2, 6, 8, 310, 238/314, 331, 336, 338, 378, 348, 349, 351, 355, 356, 357, 361, 365; 24/458, 457, 522

(56) References Cited

U.S. PATENT DOCUMENTS

| | | | | |
|---|---|---|---|---|
| 916,277 | * | 3/1909 | Dawkins | 238/314 |
| 1,050,457 | * | 1/1913 | Hellner | 238/355 |
| 1,092,198 | * | 4/1914 | Allen | 238/338 |
| 1,230,703 | * | 6/1917 | Gregg | 238/355 |
| 4,415,120 | | 11/1983 | Thim . | |
| 4,461,421 | | 7/1984 | Maass . | |
| 4,793,545 | | 12/1988 | Raymond . | |
| 4,880,158 | | 11/1989 | Cook . | |
| 4,919,330 | | 4/1990 | Winger . | |
| 5,465,903 | | 11/1995 | Davis et al. . | |
| 5,535,947 | | 7/1996 | Hogue et al. . | |
| 5,609,294 | | 3/1997 | Lucas, Jr. . | |
| 5,622,312 | | 4/1997 | Martin . | |
| 5,655,711 | | 8/1997 | Hull et al. . | |

* cited by examiner

*Primary Examiner*—Mark T. Le
(74) *Attorney, Agent, or Firm*—George A. Seaby

(57) ABSTRACT

A clip for securing a rail seal element to a rail includes a generally L-shaped first clip member having a clamping arm and an elongate connector arm extending from one end of the clamping arm and capable of passing under the rail; a second clip member removably slidable on the connector arm; and a locking mechanism capable of releasably locking the second clip member against sliding movement along the connector arm. In use, the second clip member is removed from the connector arm so that the connector arm can be passed under the rail with minimum disruption of the ballast. The second clip member is then slid back onto the connector arm, and the assembled clip then oriented so that the rail and the rail seal are positioned between the damping arm and the second clip member. The second clip member is then slid on the connector arm toward the clamping arm so as to tightly press the rail and rail seal therebetween. Finally, the second clip member is locked onto the arm to prevent the clip from releasing the rail and rail seal. A tool for setting the clip includes a lever arm, and cam body and a pivot pin mounted on a nose of the cam body. By this means, movement of the second clip member toward the clamping arm is caused by inserting the pivot pin into a tool notch on the first clip member and thereafter pivoting the tool, about the pivot pin, toward the clamping arm. Subsequent pivoting of the tool away from the clamping arm causes the locking mechanism to automatically engage to prevent the second clip member from moving away from the clamping arm.

14 Claims, 6 Drawing Sheets

TWO-PIECE RAIL SEAL CLIP AND TOOL FOR INSTALLING SAME

SUMMARY OF THE INVENTION

This invention relates to an apparatus for securing rail seal elements on opposite sides of a rail.

In rail track construction, it is frequently necessary and/or desirable to align the rail head with adjacent road surfaces in order to facilitate movement of pedestrian and vehicular traffic. This commonly occurs at level crossings, and in light rail systems where rail and vehicular traffic share a common right of way. In order to prevent fouling of the rails in these installations, it is common practice to install rubber or resilient polymer rail seals which serve to seal a space between each rail and the adjacent road surface. Typical examples of such rail seals can be seen in U.S. Pat. No. 4,461,421 (Maass). Rail seals of the type described in U.S. Pat. No. 4,461,421 (Maass) have the advantages of being easy to manufacture in large quantity and at low cost, while offering an effective means of preventing fouling of the rails by ice, snow or other foreign matter.

In order to further reduce the costs of maintaining the road surface, it is frequently necessary to install the rail seals on each side of the rails prior to construction of the adjacent road surfaces. The rail seals then serve as forms during the pouring of concrete or laying of asphalt for the road surface.

However, in order to retain the rail seals on each side of the rails during construction and throughout the service life of the crossing, it is necessary to provide some means of securing the rail seals in place. For this purpose, it is known to employ a generally U-shaped spring clip 4 which is designed to be inserted under the rail 1 between adjacent ties. The ends 5, 6 of the spring clip 4 are then maneuvered into position to press the rail seals 2, 3 against the rail 1 (see FIG. 1). This arrangement suffers from numerous disadvantages. In particular, in order to install the spring clip 4, a quantity of ballast (crushed stone) must be removed from between adjacent ties. This is time consuming and labor intensive thereby increasing costs. Concerns have also been raised that the removal of ballast in this way might undermine the footings of the rail, thereby leading to more rapid degradation of the track. Additionally, in order to generate sufficient holding forces, the spring clips typically need to be made of spring steel, which greatly increases their cost. Finally, experience has shown that once such spring clips have been installed, it is extremely difficult to remove them later, for example in order to conduct maintenance or upgrading of the rail.

An object of the present invention is to provide a clip for securing rail seals to a rail which overcomes the above-noted disadvantages of the prior art.

A further object of the present invention is to provide a clip which can be installed with minimum labor, and while minimizing any disruption of the rail ballast.

It is a further object of the present invention to provide a clip which can be readily removed.

Accordingly, an aspect of the present invention provides a clip for securing a rail seal to a rail, the clip comprising a generally L-shaped clip bar having a clamping arm and an elongate connector arm extending from one end of the clamping arm and capable of passing under the rail, a clip arm removably slidable on the connector arm, and a locking mechanism capable of releasably locking the clip arm against sliding movement along the connector arm. In use, the clip arm is removed from the connector arm so that the connector arm can be passed under the rail with minimum disruption of the ballast. The clip arm is then slid back onto the connector arm, and the assembled clip is then oriented so that the rail and the rail seal are positioned between the clamping arm and the clip arm. The clip arm is then slid on the connector arm toward the clamping arm so as to tightly press the rail and rail seal therebetween. Finally, the clip arm is locked onto the connector arm to prevent the clip from releasing the rail and the rail seals.

In an embodiment of the invention, the clip arm is formed as a curvilinear body. A contact pad designed to engage an outer surface of a rail seal is disposed near one end of the body, and an opening capable of slidably receiving the connector arm is provided near an opposite end of the body.

The clip arm further includes a bearing surface between the contact pad and the opening. By this means, the clip arm is slidable on the connector arm toward the clamping arm in response to a force acting on the bearing surface.

The locking mechanism comprises a plurality of notches in an upper surface of the connector arm, and an edge or corner of the opening in the clip arm. By this means, a resilient force of a rail seal secured by the clip causes the clip arm to rotate until the corner of the opening engages one of the notches of the connector arm, thereby preventing sliding motion of the clip arm away from the clamping arm.

A tool notch is provided near a free end of the connector arm of the clip bar.

A tool capable of being removably coupled to the connector arm and the clip arm is used for forcibly sliding the clip arm toward the clamping arm to clamp the rail seal element against the rail, and for engaging the locking means to prevent undesired motion of the clip arm away from the clamping arm.

The tool comprises a pivot pin capable of being removably engaged in the tool notch of the connector arm, and cam surfaces capable of engaging the contact face of the clip arm. In this case, movement of the clip arm toward the clamping arm is caused by inserting the pivot pin into the tool notch and thereafter pivoting the tool about the pivot pin toward the clamping arm. Subsequent pivoting of the tool away from the clamping arm causes the locking mechanism to automatically engage to prevent the clip arm from moving away from the clamping arm.

BRIEF DESCRIPTION OF THE DRAWINGS

Further features and advantages of the present invention will become apparent from the following detailed description, taken in combination with the appended drawings, in which.

DETAILED DESCRIPTION

Figure 1:
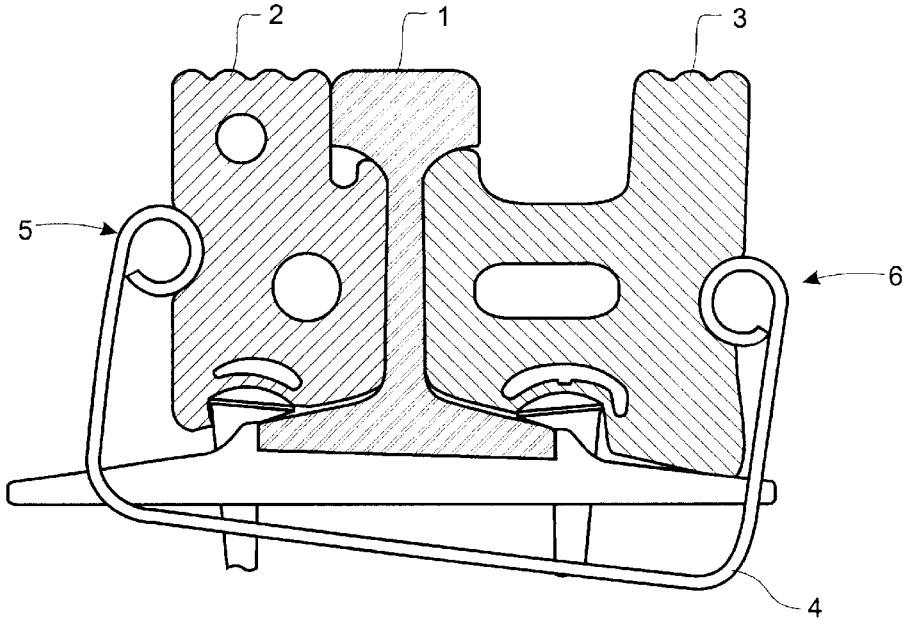
Figure 1 (Prior Art)
FIG. 1 is a cross-sectional view of a rail and a pair of rail seals secured to opposite sides of the rail by means of a conventional spring clip.
Figure 2:
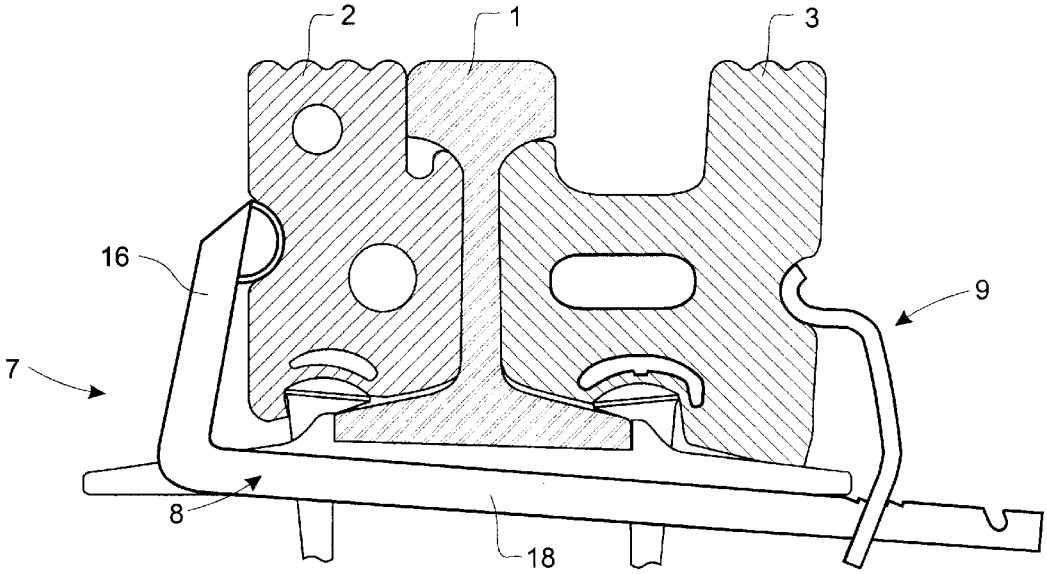
FIG. 2 is a cross-sectional view of a pair of rail seals secured to opposite sides of a rail by means of a clip in accordance with of the present invention.
Figure 3A:
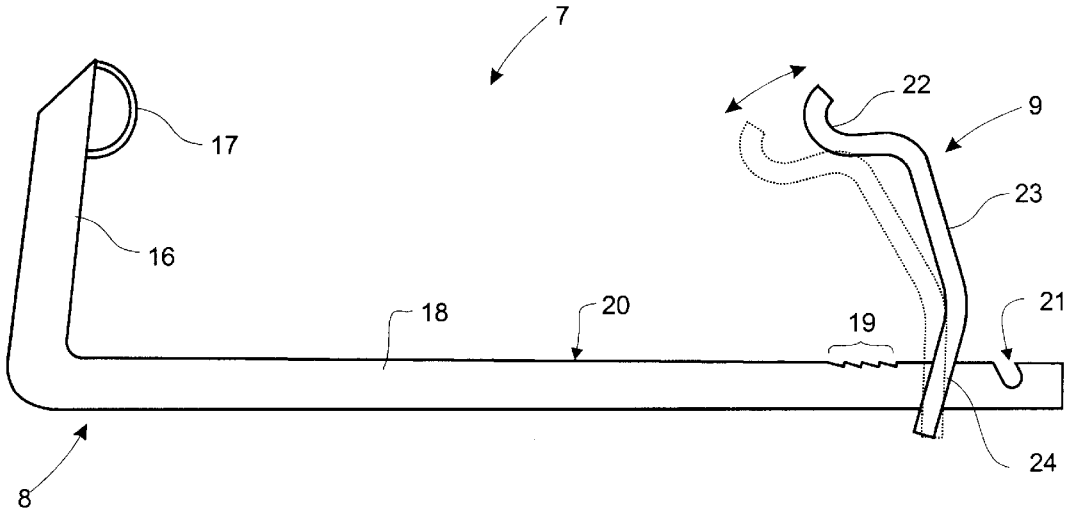
FIG. 3*a* is a front view of the clip of FIG. 2.
Figure 3B:
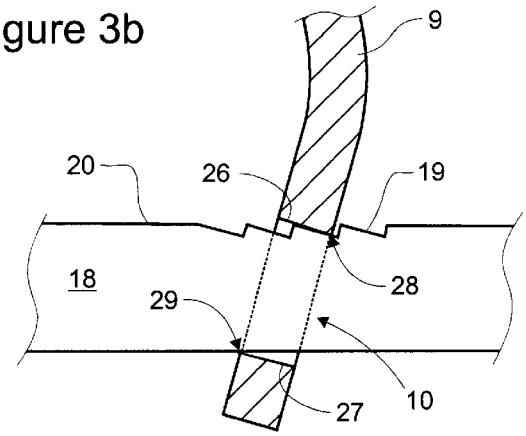
FIG. 3*b* is a partial cross-sectional view illustrating the operation of the locking mechanism of the embodiment of FIG. 2.
Figure 3C:
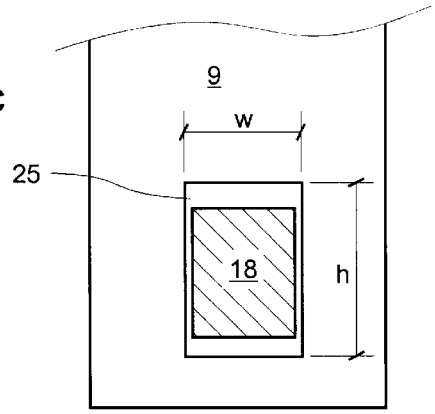
FIG. 3*c* is a cross-sectional view showing the lower portion of the second clip member of the embodiment of FIG. 2.
Figure 4:
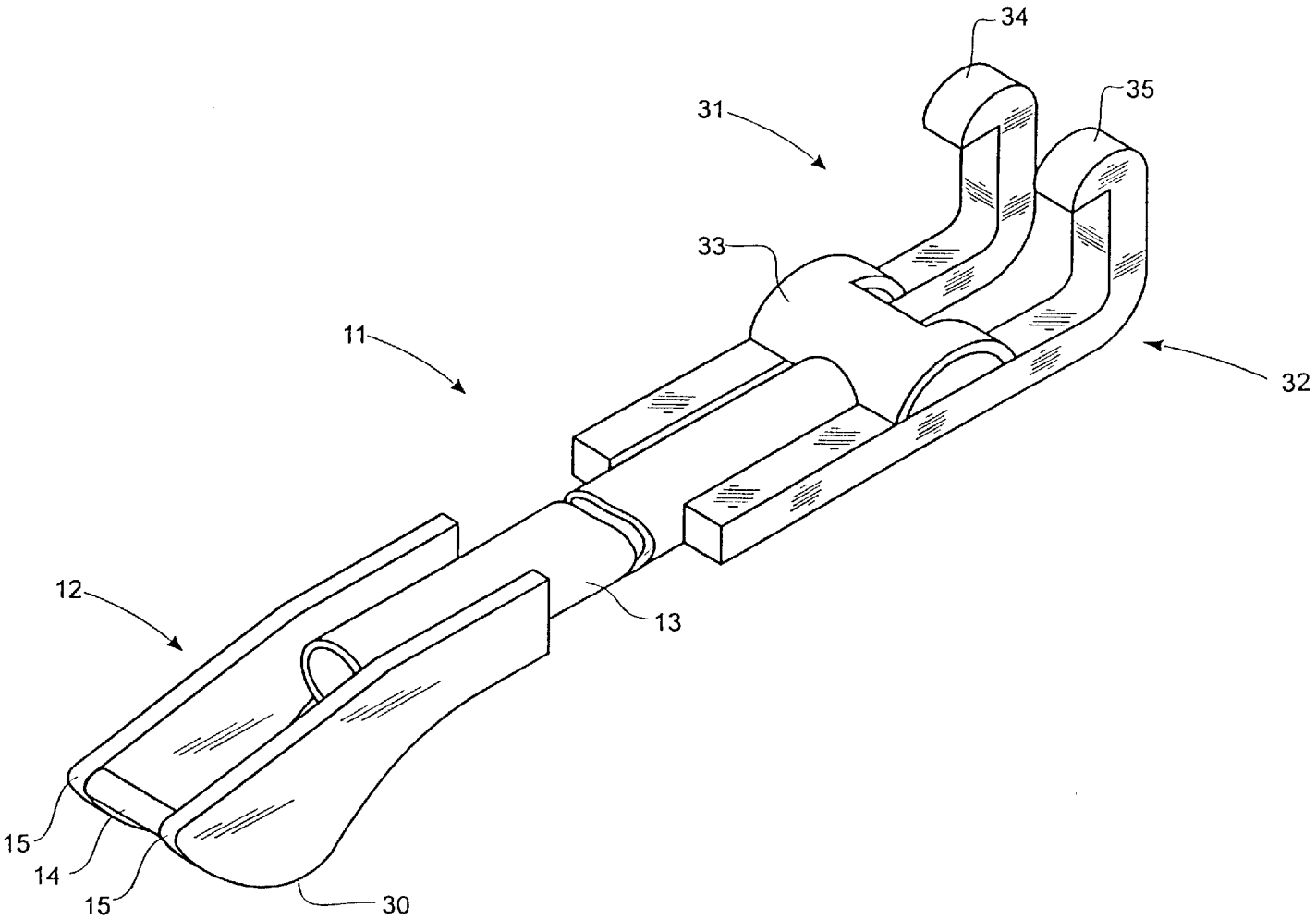
FIG. 4 is an isometric view of a tool for installing and removing the clip of FIG. 2.

Referring to FIGS. 2 and 3*a* to 3*c*, a clip 7 in accordance with the present invention comprises a generally L-shaped bar 8, an arm 9 removably slidable on the bar 8, and a locking mechanism generally indicated at 10. As shown in FIG. 4, a setting tool 11 for setting the clip 7 on a rail 1 and rail seals 2, 3 comprises a bifurcated cam body generally indicated at 12 mounted on a free end of a lever arm 13, and a pivot pin 14 disposed on a nose 15 of the cam body 12.

The bar 8 can conveniently be formed from a single piece of mild steel barstock bent to form an L-shaped body having arms of unequal length. The shorter of the two arms defines a clamping arm 16 and is designed to engage a rail seal 2 on one side of the rail 1. For this purpose, the clamping arm 16 can conveniently be provided with a rounded contact pad 17 (FIG. 3*a*) disposed at the free end of the clamping arm 16. By this means, the clamping arm 16 can be forcefully pressed against a face of the rail seal 2 without causing undue damage or distortion of the rail seal 2. The longer of the two arms defines a connector arm 18 which is of sufficient length to extend under the rail 1 and rail seals 2, 3 as shown in FIG. 2. A plurality of locking notches 19 are provided on an upper surface 20 of the connector arm 18, and define a portion of the locking mechanism 10. Finally, a tool notch 21 is provided near a free end of the connector arm 18 for receiving the pivot pin 14 of the setting tool 11.

The arm 9 can conveniently be formed of a suitable piece of mild steel strap bent to define an arcuate body. A concavo-convex upper end of the body defines a contact pad 22 designed for bearing against a surface of rail seal 3. A substantially flat central portion of the arm defines a bearing surface 23 against which the tool 11 can be used to move the arm 9 toward the rail seal 3 and simultaneously engage the locking mechanism 10 to lock the arm 9 in place on the connector arm 18. A straight, flat lower end 24 of the body includes an opening 25 for slidably receiving the connector arm 18 of the bar 8. As seen in FIG. 3*c*, the width w of the opening 25 is preferably sufficiently large to provide a small clearance with the sides of the connector arm 18, so that the arm 9 can easily slide along the connector arm 18, but an acceptable alignment between the clamping arm 16 and the clip arm 9 can be maintained. The height h of the opening 25 is sufficiently greater than the height of the connector arm 18 so that the clip arm 9 is capable of pivoting through a small angle, as shown in FIG. 3*a*. As described in greater detail below, this pivoting motion of the clip arm 9 is essential to successful operation of the locking mechanism 10.

As mentioned above, the locking notches 19 provided on the connector arm 18 define a portion of the locking mechanism 10. The remaining portions of the locking mechanism are defined by the upper and lower interior surfaces 26 and 27 of the opening in the clip arm 9, and the upper and lower corners 28 and 29 of the opening 25 which abut the top and bottom surfaces of the clip arm 9 (FIG. 3*b*).

Referring now to FIG. 4, in accordance with the present invention, the setting tool 11 for setting the clip 7 on a rail 1 and rails seals 2 and 3 includes the bifurcated cam body 12 having cam surfaces 30 (one shown) mounted on a free end of the lever arm 13, and the pivot pin 14 disposed on the nose 15 of the cam body 12. The lever arm 13 is formed of any suitable material, such as, for example a piece of steel pipe. Similarly, the length of the lever arm 13 can be selected as desired commensurate with the need to provide adequate leverage to properly set the clip, while allowing adequate portability of the tool. In practice, a lever arm in the range of between 40 and 50 inches in length has been found to be beneficial. The cam body 12 is designed such that, when the pivot pin 14 is inserted into the tool notch 21 of the connector arm 18, then the cam surfaces 30 will bear against the bearing surface 23 of the clip arm 9. In this condition, pivoting of the setting tool 11 in the direction of arrow T (FIG. 5*d*), will cause the cam body 12 and pivot pin 14 to generate very high forces simultaneously acting on the bar 8 and the clip arm 9 to force the arm 9 toward the clamping arm 16 against the resistance of the rail seals 2 and 3 on opposite sides of the rail 1.

Once the clip has been set in this manner, the pivot pin 14 can be removed from the tool notch 21 of the connector arm 18, and the setting tool 11 removed for reuse with another clip 7.

Figure 5A:
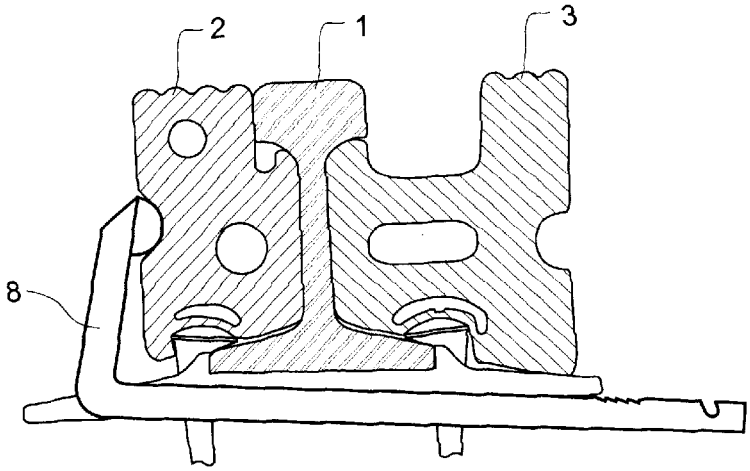
FIGS. 5*a* to 5*e* are cross-sectional views similar to FIG. 2 showing the steps for installing the clip of FIG. 2 using the tool of FIG. 4.
Figure 5B:
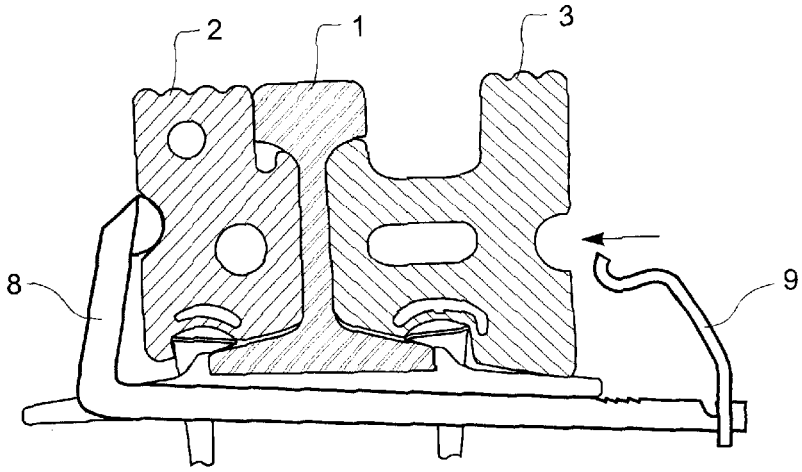
Figure 5C:
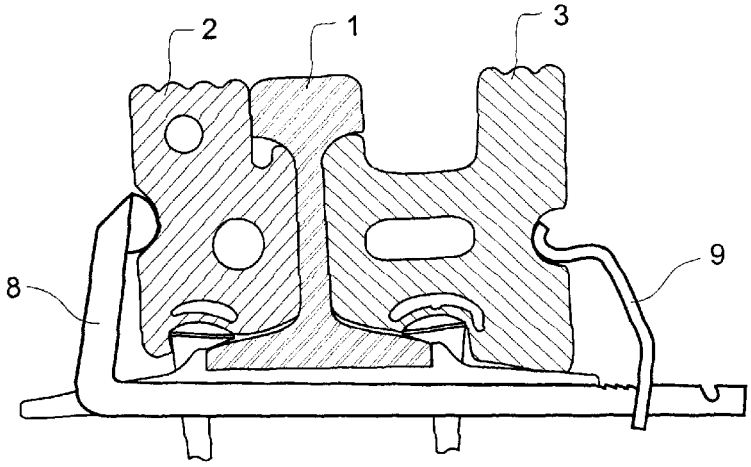
Figure 5D:
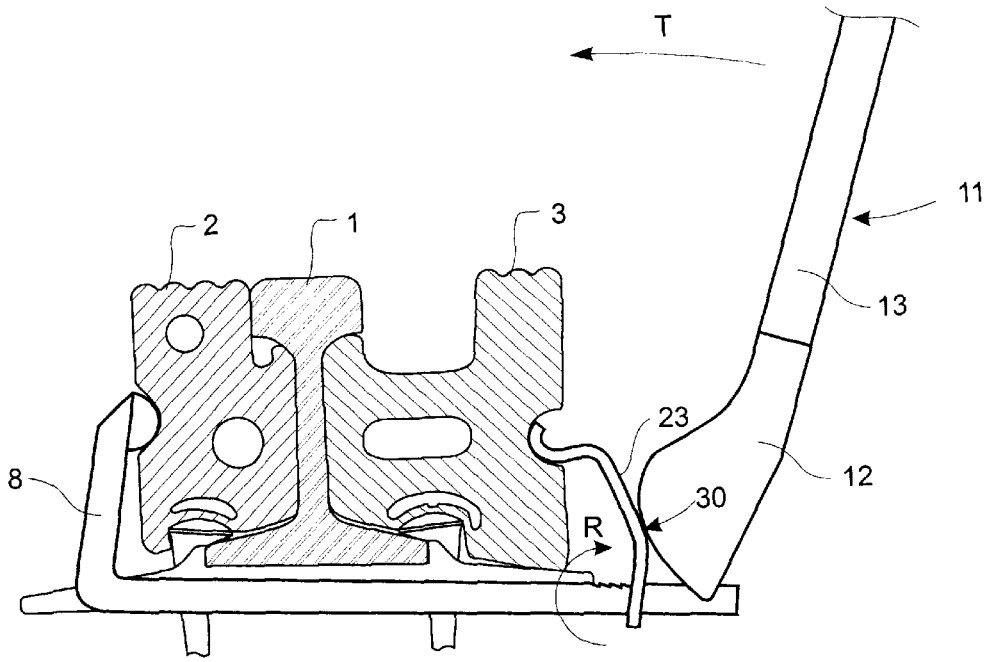
Figure 5E:
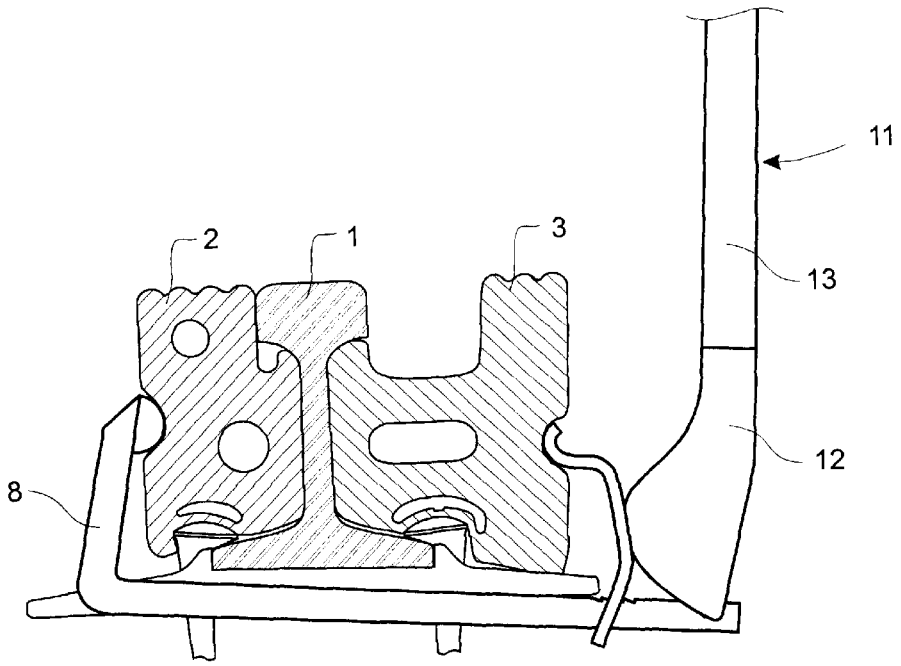

The method of setting the clip 7 onto a rail 1 and rail seals 2 and 3, and the operation of the locking mechanism 10, will now be described with reference to FIGS. 5*a*–5*e*. As an initial step (FIG. 5*a*), the connector arm 18 of the bar 8 is slid under the rail 1 and rails seals 2 and 3, between adjacent ties, until the contact pad 17 of the arm 16 bears "hand-tight" against the rail seal 2. Typically, this step can be quickly and easily accomplished with minimal use of tools, and with minimum disruption of ballast. The clip arm 9 is then slid onto the arm 18 (FIG. 5*b*) until the pad 22 bears "hand-tight" against the opposite rail seal 3. At this stage, the setting tool 11 can be used to set the clip 7, and thereby tightly clamp the rail seals 2 and 3 and rail 1 between the clamping arm 16 of the clip bar 8 and the contact pad 22 of the clip arm 9 (FIGS. 5*d*–5*e*).

As described above, pivoting the setting tool 11 in the tool notch 21 causes the cam surfaces 30 of the cam body 12 to apply force to the bearing surface 23 of the clip arm 9. This force is distributed between the upper and lower ends of the clip arm 9, thereby causing compression of the rail seals 2 and 3 between the clamp arm 16 and the clip arm 9, and rotation of the clip arm in the direction of arrow R (FIG. 5*d*) as the lower end 24 continues to advance. Rotation of the arm 9 is limited by the height h of the opening 25, i.e. the arm 9 will rotate until the upper and lower interior surfaces 26 and 27 of the opening 25 contact the upper and lower surfaces of the connector arm 18. In this condition, the upper corner 28 engages one of the notches 19, and contact between the lower corner 29 and the lower surface of the connector arm 18 prevents disengagement of the upper corner 28, so that rearward movement of the lower end 24 of the clip arm 9 (and thus releasing the compression of the rail seals 2 and 3 within the assembled clip 7) is prevented.

If it is desired to remove the clip arm 9 from the connector arm 18, then it is necessary to cause disengagement of the upper corner 28 of the opening 25 from its corresponding notch 19 on the connector arm 18. This can be accomplished by applying a force couple to the lower end 24 of the clip arm 9 so as to cause (by a combination of compression of the rail seals 2 and 3 and elastic flexure of the clip arm 9) rotation of the lower end 24 in a direction indicated by arrow S in FIG. 6*a*. This rotation causes disengagement between the lower corner 29 of the opening 25 and the lower surface of the connector arm 18, thereby allowing the upper corner 28 to rise out of engagement with its corresponding notch 19 (see FIGS. 6*a* and 6*b*).

Figure 6A:
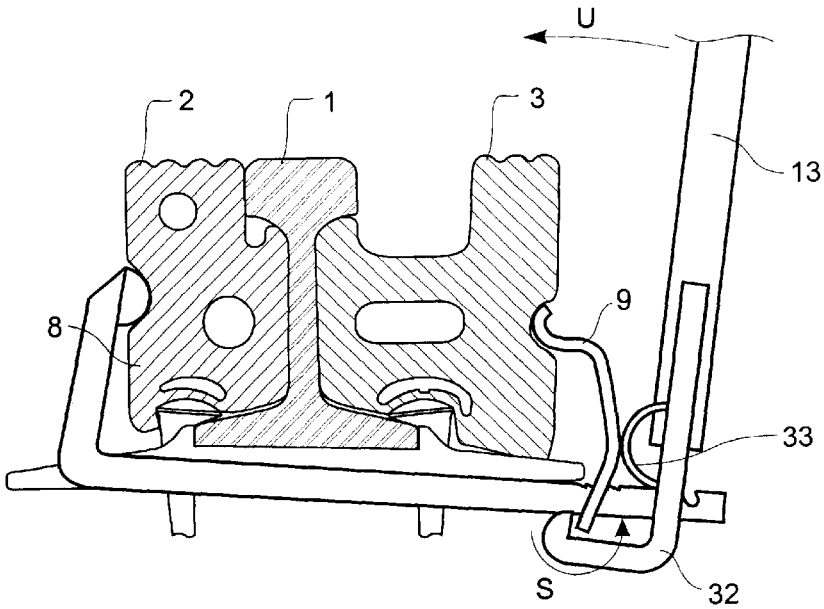
FIGS. 6*a* and 6*b* are cross-sectional views similar to FIG. 2 illustrating the steps for removing the clip of FIG. 2 using the tool of FIG. 4.
Figure 6B:
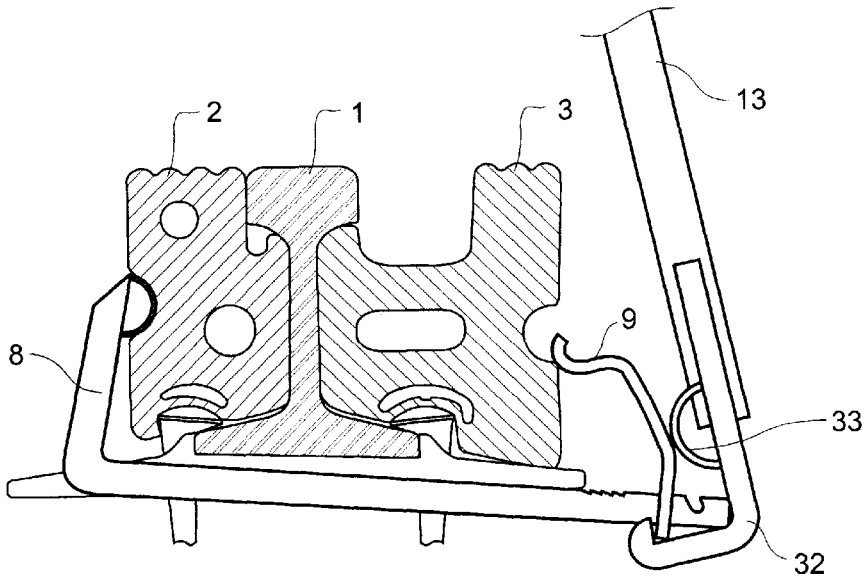

According to the present invention, removal of the clip arm 9 is accomplished using a releasing tool 31 of the type illustrated in FIG. 4. In the illustrated embodiment, the releasing tool 31 comprises a bifurcated hook 32, and a pressure bar 33 mounted on a second end of the lever arm 13. Conveniently, the hook 32 and the pressure bar 33 are mounted on the end of the lever arm 13 opposite the end carrying the setting tool 11. The hook 32 is defined by a pair of hook arms 34 and 35 arranged to straddle the connector arm 18 when in use. The hook 32 and pressure bar 33 are designed to cooperatively engage opposite sides of the lower end 24 of the clip arm 9, as shown in FIGS. 6*a* and 6*b*. In this connection, rotation of the releasing tool 31 in the direction of the arrow U will cause rotation of the lower end 24 of the clip arm 9, which releases the arm 9 as described above.

Those skilled in the art will appreciate that various modifications may be made without departing from the scope of the invention as defined by the appended claims. Thus it will be understood that the above-described embodiments are intended to be illustrative, rather than limiting of the present invention.

What is claimed is:

1. An apparatus for securing first and second rail seals on opposite sides of a rail comprising a clip, said clip including:

(a) a clip bar capable of operatively engaging the first rail seal disposed on one side of the rail, and including an elongate connector arm capable of extending under the rail to protrude a distance outwardly from a side of the rail opposite the first rail seal;

(b) a clip arm engaging the second rail seal disposed on the side of the rail opposite the first rail seal, and including an opening permitting sliding of the clip arm on the connector arm;

(c) locking notches in said connector arm permitting sliding of said clip arm in a first direction toward said second seal and for engaging said clip arm to prevent sliding of the clip arm in a second direction away from said second seal, whereby said rail seals are held against said rail by said clip bar and said clip arm.

2. An apparatus as defined in claim 1, wherein the clip bar includes a generally L-shaped body having two bar arms of unequal length, a shorter one of the two bar arms defining a clamping arm for engaging the first rail seal, and a longer one of the two bar arms defining said connector arm.

3. An apparatus as defined in claim 2, wherein the clip bar further comprises a first contact pad at a free end of the clamping arm, the first contact pad acting to prevent undue distortion of or damage to the first rail seal.

4. An apparatus as defined in claim 2, wherein the clip bar comprises a tool notch near a free end of the connector arm.

5. An apparatus as defined in claim 3, wherein the clip arm comprises an upper end defining a second contact pad for operatively engaging the second rail seal, and a lower end containing said opening.

6. An apparatus as defined in claim 5, wherein the opening is sufficiently wide to provide a small clearance with the sides of the connector arm, such that the clip arm can easily slide along the connector arm, while preventing substantial misalignment between the clip arm and the clamping arm of the clip bar.

7. An apparatus as defined in claim 5, wherein the opening has a height sufficiently greater than the height of the connector arm that the clip arm is capable of pivoting through an angle with respect to the longitudinal axis of the clip bar.

8. An apparatus as defined in claim 5, wherein the upper end of the clip arm is curved, and the lower end thereof is planar.

9. An apparatus as defined in claim 5, wherein the clip arm comprises a central bearing surface between the upper and lower ends thereof, the clip arm being slidable on the connector arm in response to a force acting on the bearing surface.

10. An apparatus as defined in claim 9, wherein the bearing surface is generally planar.

11. An apparatus as defined in claim 10, wherein the lower end and the bearing surface of the dip arm are oriented at an angle with respect to each other.

12. An apparatus as defined in claim 1 wherein said locking notches are in an upper surface of the connector arm.

13. An apparatus as defined in claim 4, including a tool capable of being removably coupled to the connector arm and the clip arm, for forcibly sliding the clip arm toward the clamping arm to clamp the first and second rail seals in place.

14. An apparatus as defined in claim 13, wherein the tool includes a pivot pin capable of being removably engaged in the tool notch of the connector arm, and a cam surface capable of engaging the bearing surface of the clip arm, whereby movement of the clip arm toward the clamping arm is caused by inserting the pivot pin into the tool notch and thereafter rotating the tool about the pivot pin.

* * * * *